US006128942A

United States Patent [19]

Stevicks

[11] Patent Number: 6,128,942

[45] Date of Patent: Oct. 10, 2000

[54] BENDING MACHINE

[76] Inventor: Roy A. Stevicks, Box 413, Gregory, S. Dak. 57533

[21] Appl. No.: 09/383,681

[22] Filed: Aug. 26, 1999

[51] Int. Cl.[7] ..... B21D 7/08

[52] U.S. Cl. ..... 72/389.1; 72/213; 72/389.6

[58] Field of Search ..... 72/389.1, 389.6, 72/213

[56] References Cited

U.S. PATENT DOCUMENTS

| | | | |
|---|---|---|---|
| 4,254,651 | 3/1981 | Kelly | 72/389.1 |
| 4,790,168 | 12/1988 | Vonthien | 72/389.1 |
| 5,528,921 | 6/1996 | Herman | 72/389.1 |
| 5,615,572 | 4/1997 | Johnson et al. | 72/389.1 |
| 5,661,994 | 9/1997 | Sundquist | 72/389.6 |
| 5,761,950 | 6/1998 | Chiu | 72/389.1 |

*Primary Examiner*—David Jones

[57] ABSTRACT

A bending machine for bending and straightening tubing and plate metal includes a base, a bed mounted to the base, a sliding panel mounted to the bed, and a bending apparatus mounted to the sliding panel. The bending apparatus further includes a bending apparatus frame, a mounting arm, and hydraulic systems for moving the mounting arm and the bending apparatus frame. A limiting die is mountable to the bending apparatus frame and a bending die is mountable to the mounting arm of the bending apparatus. The mounting arm is adjustable relative to the bending apparatus frame to secure an object to be bent between the mounting die and the limiting die. The bending apparatus frame is adjustable relative to the sliding panel for further securing the object to be bent between the sliding panel and the bending apparatus frame. An adjustable pair of stop pegs are positionable to extend outwardly from the bed such that the sliding panel is passable through the stop pegs. The object being bent is secured relative to the sliding panel such that opposite ends of the object contact the stop pegs as the sliding panel passes through the stop pegs whereby the object is bent around the mounting die. In a most preferred embodiment, the mounting arm and bending frame apparatus are designed for positioning the limiting die and mounting die on either of two opposing sides of the bending apparatus frame. Additionally, an adjustable control arm is provided for controlling the various hydraulic systems.

23 Claims, 6 Drawing Sheets

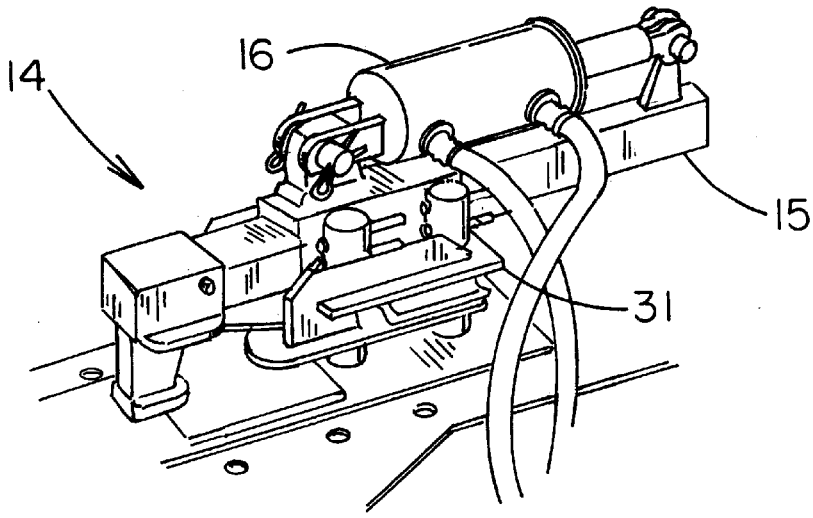
FIG. 7
FIG. 8
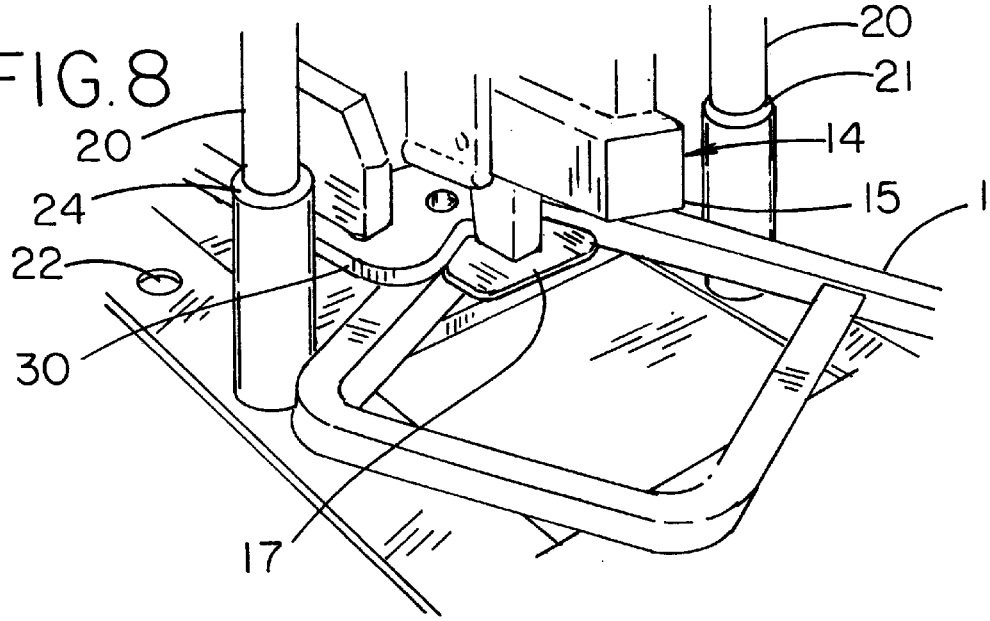
FIG. 9
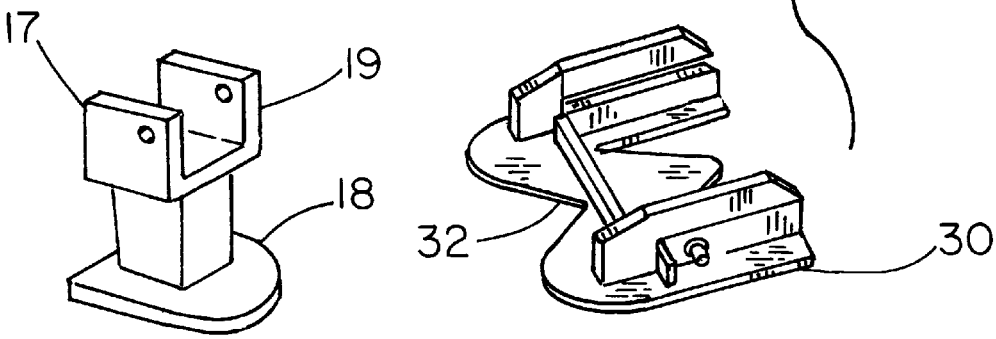

BENDING MACHINE

BACKGROUND OF THE INVENTION

1. Field of the Invention

The present invention relates to tube benders and more particularly pertains to a new bending machine for bending and straightening tubing and plate metal.

2. Description of the Prior Art

The use of tube benders is known in the prior art. More specifically, tube benders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,059,978 to Dettling; U.S. Pat. No. 4,269,054 to Eaton; U.S. Pat. No. 4,130,004 to Eaton; U.S. Pat. No. 5,784,913 to Bhandari; U.S. Pat. No. 4,821,549 to Schwarze; U.S. Pat. No. 4,141,235 to Ishihara; U.S. Pat. No. 5,682,781 to Schwarze; U.S. Pat. No. 4,210,007 to Michel; U.S. Pat. No. 3,935,721 to Boteler et al.; U.S. Pat. No. 5,431,035 to Sheen; U.S. Pat. No. 4,201,073 to Eaton; U.S. Pat. No. 5,469,730 to Heaman; U.S. Pat. No. 5,036,692 to Tasaki et al.; U.S. Pat. No. 4,875,353 to Kaneko; U.S. Pat. No. 5,259,224 to Schwarze; U.S. Pat. No. 3,713,317 to Schenck et al.; U.S. Pat. No. Des. 222,028 to Benfield; U.S. Pat. No. Des. 326,395 to Aulgur; U.S. Pat. No. Des. 345,742 to Adleman et al.; and U.S. Pat. No. Des. 242,948 to Grimaldo et al.

While these devices fulfill their respective, particular objectives and requirements, the aforementioned patents do not disclose a new bending machine. The inventive device includes a base, a bed mounted to the base, and a bending apparatus mounted to the bed that has a mounting arm that is slidably positionable with respect to the bed. A bending die is mounted to the mounting arm of the bending apparatus and is adapted for engaging an object. An adjustable pair of stop pegs are positionable to extend outwardly from the bed.

In these respects, the bending machine according to the present invention substantially departs from the conventional concepts and designs of the prior art, and in so doing provides an apparatus primarily developed for the purpose of bending and straightening tubing and plate metal.

SUMMARY OF THE INVENTION

In view of the foregoing disadvantages inherent in the known types of tube benders now present in the prior art, the present invention provides a new bending machine construction wherein the same can be utilized for bending and straightening tubing and plate metal.

The general purpose of the present invention, which will be described subsequently in greater detail, is to provide a new bending machine apparatus and method which has many of the advantages of the tube benders mentioned heretofore and many novel features that result in a new bending machine which is not anticipated, rendered obvious, suggested, or even implied by any of the prior art tube benders, either alone or in any combination thereof.

To attain this, the present invention generally comprises a base, a bed mounted to the base, and a bending apparatus mounted to the bed that has a mounting arm that is slidably positionable with respect to the bed. A bending die is mounted to the mounting arm of the bending apparatus and is adapted for engaging an object. An adjustable pair of stop pegs are positionable to extend outwardly from the bed.

Additionally, a control arm is provided for controlling the various hydraulic systems. The control arm is adjustable to permit use of the present invention from a multitude of positions relative to the object being bent.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bending machine apparatus and method which has many of the advantages of the tube benders mentioned heretofore and many novel features that result in a new bending machine which is not anticipated, rendered obvious, suggested, or even implied by any of the prior art tube benders, either alone or in any combination thereof.

It is another object of the present invention to provide a new bending machine that may be easily and efficiently manufactured and marketed.

It is a further object of the present invention to provide a new bending machine that is of a durable and reliable construction.

An even further object of the present invention is to provide a new bending machine which is susceptible of a low cost of manufacture with regard to both materials and labor, and which accordingly is then susceptible of low prices of sale to the consuming public, thereby making such bending machine economically available to the buying public.

Still yet another object of the present invention is to provide a new bending machine which provides in the apparatuses and methods of the prior art some of the advantages thereof, while simultaneously overcoming some of the disadvantages normally associated therewith.

Still another object of the present invention is to provide a new bending machine for bending and straightening tubing and plate metal.

Yet another object of the present invention is to provide a new bending machine which includes a base, a bed mounted to the base, and a bending apparatus mounted to the bed that has a mounting arm that is slidably positionable with respect to the bed. A bending die is mounted to the mounting arm of the bending apparatus and is adapted for engaging an object. An adjustable pair of stop pegs are positionable to extend outwardly from the bed.

Still yet another object of the present invention is to provide a new bending machine that pivots on its base between a horizontal and vertical position to permit bending of long pieces of tubing at an angle so that an outer end of the tube will not strike a wall or ceiling but rather will move towards a corner formed between the wall and ceiling as it bends.

Even still another object of the present invention is to provide a new bending machine that has a dual action bending mechanism that permits reversing of the dies used to bend the metal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a schematic detailed perspective view of the present invention.

FIG. 8 is a schematic partial perspective view of the present invention in use.

FIG. 9 is a schematic perspective view of dies of the present invention.

DESCRIPTION OF THE PREFERRED EMBODIMENT

Figure 1:
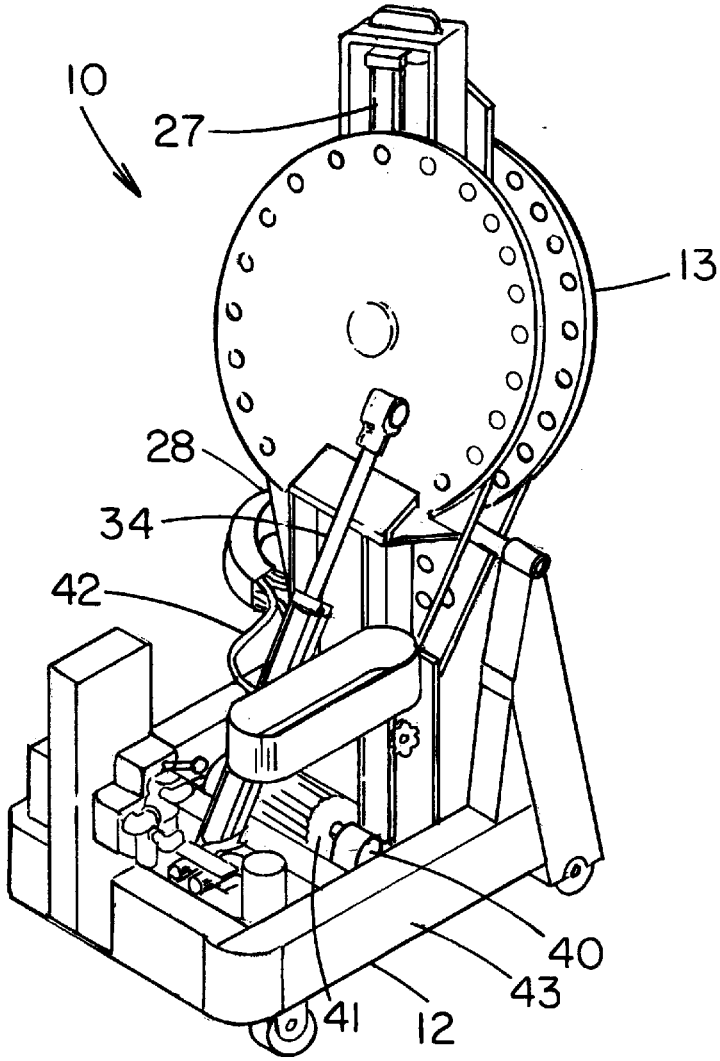
FIG. 1 is a schematic perspective view of a new bending machine according to the present invention.
Figure 2:
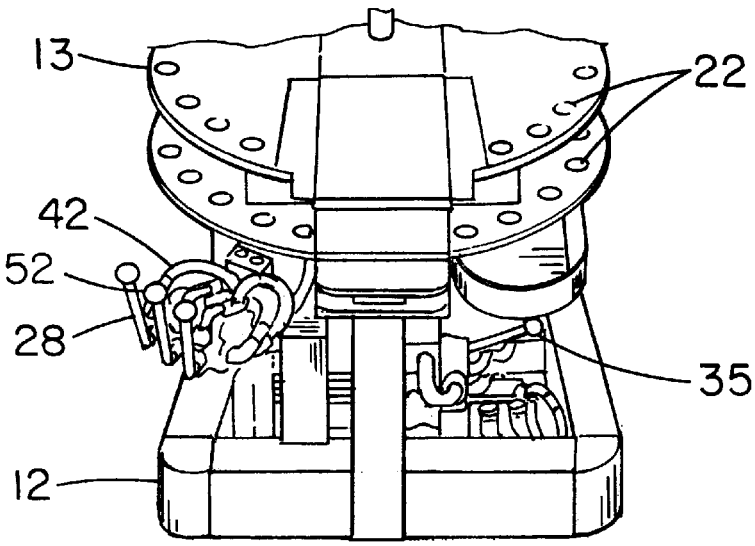
FIG. 2 is a schematic partial perspective view of the present invention.

With reference now to the drawings, and in particular to FIGS. 1 through 11 thereof, a new bending machine embodying the principles and concepts of the present invention and generally designated by the reference numeral 10 will be described.

As best illustrated in FIGS. 1 through 11, the bending machine 10 generally comprises a base 12, a bed 13 mounted to the base 12, the bed 13 having adjustable stop pegs 20 extending from the bed 13, and a bending apparatus 14 mounted to a sliding panel 24 on the bed 13.

The bending apparatus 14 has a bending apparatus frame 51 that is mounted to the sliding panel 24. The bending apparatus 14 includes a mounting arm 15 that is extendable outwardly from either side of the frame 51. Preferably, a first hydraulic piston and cylinder actuator 16 is used to move the mounting arm 15 relative to the frame 51 and the sliding panel 24.

The bed 13 is structured to include a plurality of spaced aperture pairs 58 wherein each the aperture pairs 58 is aligned substantially transverse to a longitudinal axis of the bed 13. The spaced aperture pairs 58 are positioned such that one aperture of each individual aperture of the pair 58 is positioned on an opposite side of the sliding panel 24 from the other aperture. Each aperture of each spaced aperture pair 58 is designed for receiving a respective one of the pair of stop pegs 20 so that the stop pegs extend out from the bed 13 on either side of the sliding panel 24. The sliding panel 24 is positioned to pass between the pair of stop pegs 20.

The sliding panel 24 is substantially centrally positioned to extend between front 25 and rear 26 ends of the bed 13. The sliding panel 24 is preferably moved relative to the bed 13 using a second hydraulic piston and cylinder actuator 27. Using a sliding panel control lever 52 on a control arm 28, the sliding panel 24 is slidably positionable along the bed 13 between the front and rear ends 25 and 26.

A bending die 17 is selectively mountable to one of a first and a second end of the mounting arm 15 depending on which side of the frame 51 the object being bent is placed. The bending apparatus frame 51 is further designed for having a limiting die 30 coupled to either side of the frame 51 again depending on the placement of the object being bent. The mounting arm 15 is adjustably positionable such that the bending die 17 and the limiting die 30 are designed for positioning on opposite sides of the object for securing the object between the bending die 17 and the limiting die 30. The limiting die 30 is held stationary with respect to the frame 51 and the bending die 17 is moved by actuating the mounting arm 15 to secure the object being bent between the limiting die 30 and the bending die 17. The limiting die 30 is designed for abutting the object for limiting an extent of bending of the object as the bending apparatus 14 is passed between the spaced pair of stop pegs 20 by the sliding panel 24.

A fourth hydraulic piston and cylinder actuator 45 is operationally attached to the frame 51 for positioning the bending apparatus frame 51 in spaced relationship to the sliding panel 24 such that the bending apparatus 14 is designed for selectively clamping an object between the bending apparatus frame 51 and the sliding panel 24. Thus the object is adjustably securable between the limiting die 30, the bending die 17, the frame 51 and the sliding panel 24.

The control arm 28 is operationally coupled to the base 12 for controlling positioning of the sliding panel 24 along the bed 13, the frame 51 relative to the sliding panel 24, and the mounting arm 15 relative to the frame 51. The control arm 28 preferably is pivotally coupled to the base 12 and includes at least one pivot point 36 along an extent of the control arm 28 such that the control arm 28 is designed for adjusting a working position of the control arm 28 relative to the bed 13 of the machine. Each pivot point 36 along the control arm 28 most preferably includes an associated locking device 66 for selectively preventing pivoting of the control arm 28 about the pivot point 36 whereby the control arm 28 is selectively lockable into a static chosen position.

Most preferably, the bed 13 is pivotally mounted to the base 12 such that the bed 13 is pivotable between a vertical and a horizontal position using a third hydraulic piston and cylinder actuator 34. In use it has been found that bending of certain larger or longer tubes can more easily be accomplished when the bed is oriented in a substantially vertical plane. Because the object is secured between the bending die 17, the mounting die 30, the frame 51, and the sliding panel 24, the object is secured during bending which permits one person control of the bending without the need for an additional person to hold the object. By controlling the release of the bending die 17 and frame 51, the object can be more easily handled by a single person.

In a most preferred embodiment the base 12 includes a tray 37 pivotally coupled to the base 12 and designed for holding extra dies or other related tools.

A graduated indicator 68 mounted to the bed 13 proximate the sliding panel 24 and a pointer member 69 is coupled to the sliding panel 24 proximate the graduated indicator 68 for providing visual indication of a distance traveled by the sliding panel 24. Thus an amount of bending can be monitored by measuring the distance the pointer member 69 travels along the graduated indicator 68.

For bending of larger objects such as tubing 4 inches by 4 inches and larger, a mounting member 33 extends from the sliding panel 24 proximate an end of the bending apparatus 14. The mounting member 33 is for selectively coupling a mounting die thereto. Stop pegs 20 are again positioned in selected adjustment holes in the bed 13 to engage the object on opposite sides of the mounting member. The object is then bendable by moving the sliding panel 24, and thus the mounting member and mounting die between the stop pegs 20.

Preferably, the mounting arm is elongate and has a generally rectangular transverse cross section that extends through a complementary sleeve of the bending apparatus.

A bending die 17 is detachably mounted to the mounting arm of the bending apparatus and is adapted for engaging an object 1 such as tubing. Different shapes of bending dies will be used for different jobs. An exemplary bending die especially suited for bending square tubing has a flat head 18 with a rounded tip that engages the piece of metal being bent. This bending die also has a pair of wings 19 that are couplable to the mounting portion.

Ideally, each of the pegs 20 has a sleeve 21 rotatably wrapped around it to reduce friction between a piece of metal being bent and the pegs.

Figure 6:
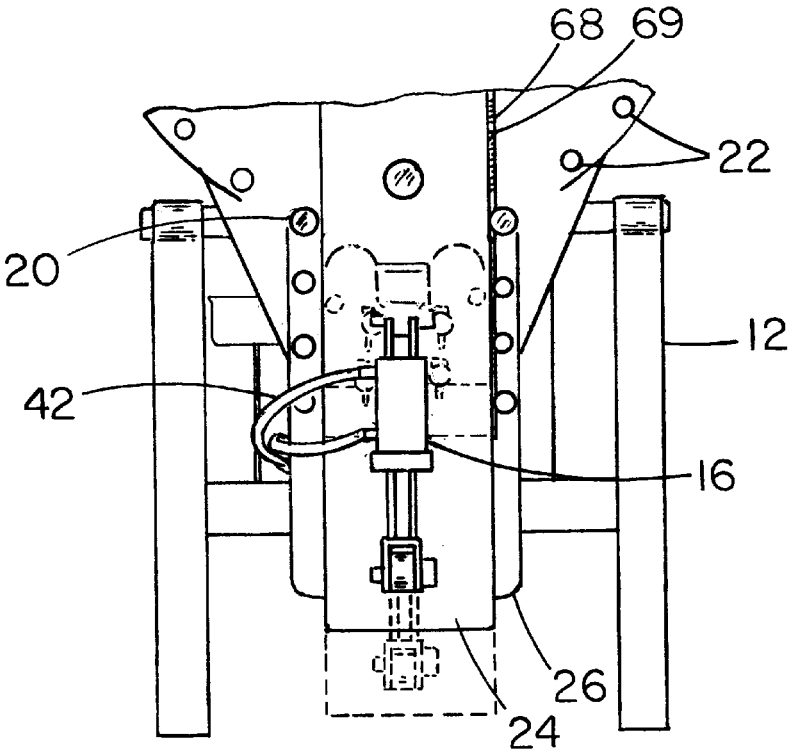
FIG. 6 is a schematic partial top view of the present invention.
Figure 10:
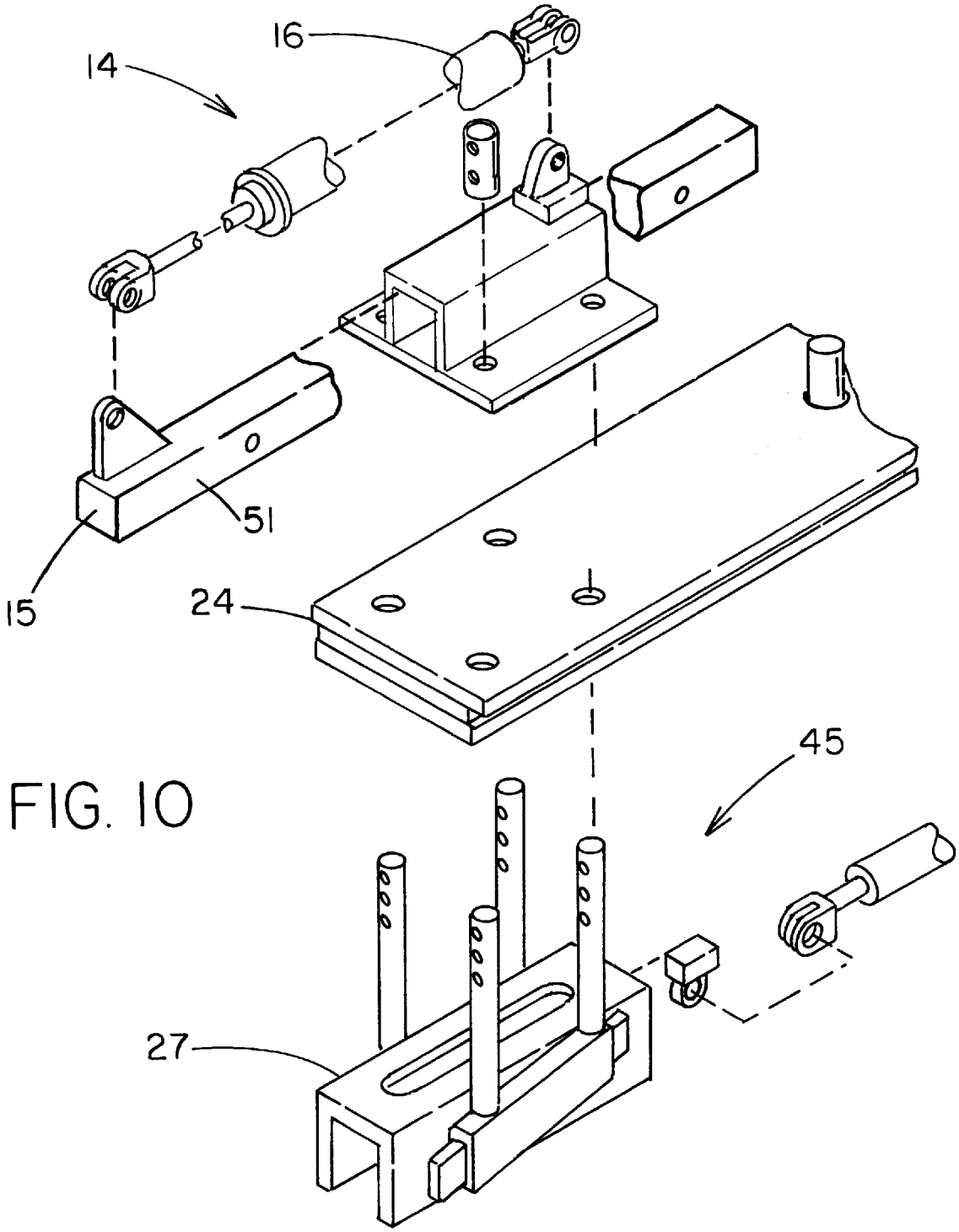
FIG. 10 is an exploded view of the connection of the bending apparatus.
Figure 11:
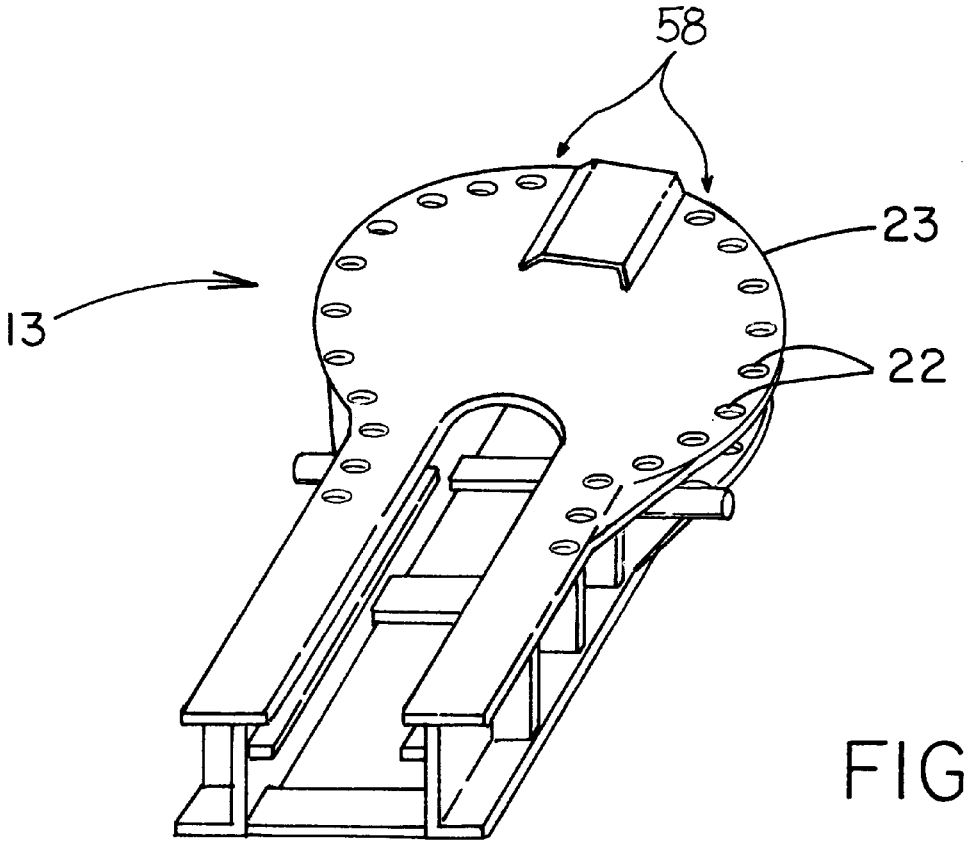
FIG. 11 is a perspective view of the bed of the present invention.

The pegs 20 are inserted in adjustment holes 22 that are arranged in rows along the outside of the bed to form the aperture pairs 58. Referring to FIG. 6, it is seen that the bed most preferably includes two rows of adjustment holes 22. However, the holes may be otherwise arranged on the bed 13 provided the structural integrity of the bed is not overly compromised. FIG. 1 shows a rounded portion 23 of the bed around which the rows of adjustment holes travel and into which the stop pegs may be placed for abutting larger and smaller objects being bent.

Preferably, the bed has a centrally positioned sliding panel 24 extending between front and rear ends 25 and 26 thereof. The sliding panel is slidably positionable along the bed between its front and rear ends and the bending apparatus is coupled to the sliding panel. This is the preferred configuration because it permits the bending apparatus to bend smaller pieces of metal using only movement of the mounting arm, while the second hydraulic piston and cylinder actuator 27 is used to move the sliding panel along the bed, and thus the whole bending apparatus, to bend the object with the assistance of forces applied to the object by the stop pegs as the object passes through the stop pegs. Ideally, the second hydraulic piston and cylinder actuator is more powerful than the first piston and cylinder actuator of the bending apparatus.

Preferably, a control arm 28 is coupled to the base and has a plurality of hydraulic controls 29 such as levers and valves in fluid communication with a hydraulic system for controlling flow of hydraulic fluid to the first, second and fourth hydraulic piston and cylinder actuators. The third hydraulic piston and actuator is preferably positioned separately from the other hydraulic controls 29 to prevent accidental pivoting of the bed during use.

A limiting die 30 is mountable to a lower platform 31 of the bending apparatus for limiting an extent of bending of the object by providing a surface against which the bending die abuts as it is bending the object. A front channel 32 of the limiting die may be lengthened or shortened to adjust the final angle of bend of the piece of metal. The limiting die is positioned such that it also abuts the upper surface of square tubing to prevent bulging out of the sides of the square tubing as it is bent.

Optionally, the sliding panel of the bed may have a cylindrical or rectangular shaped mounting member 33 extending therefrom. The mounting member is adapted for receiving mounting dies (not shown) of various shapes which are designed for heavier duty use than the other dies set forth above. To bend an object using the mounting member, the stop pegs are positioned in desired adjustment holes in the bed and the object to be bent is placed between the stop pegs and the mounting member. The mounting member moves with the sliding panel, bending the object. A second die may be coupled to the mounting member for different types of bending.

Figure 3:
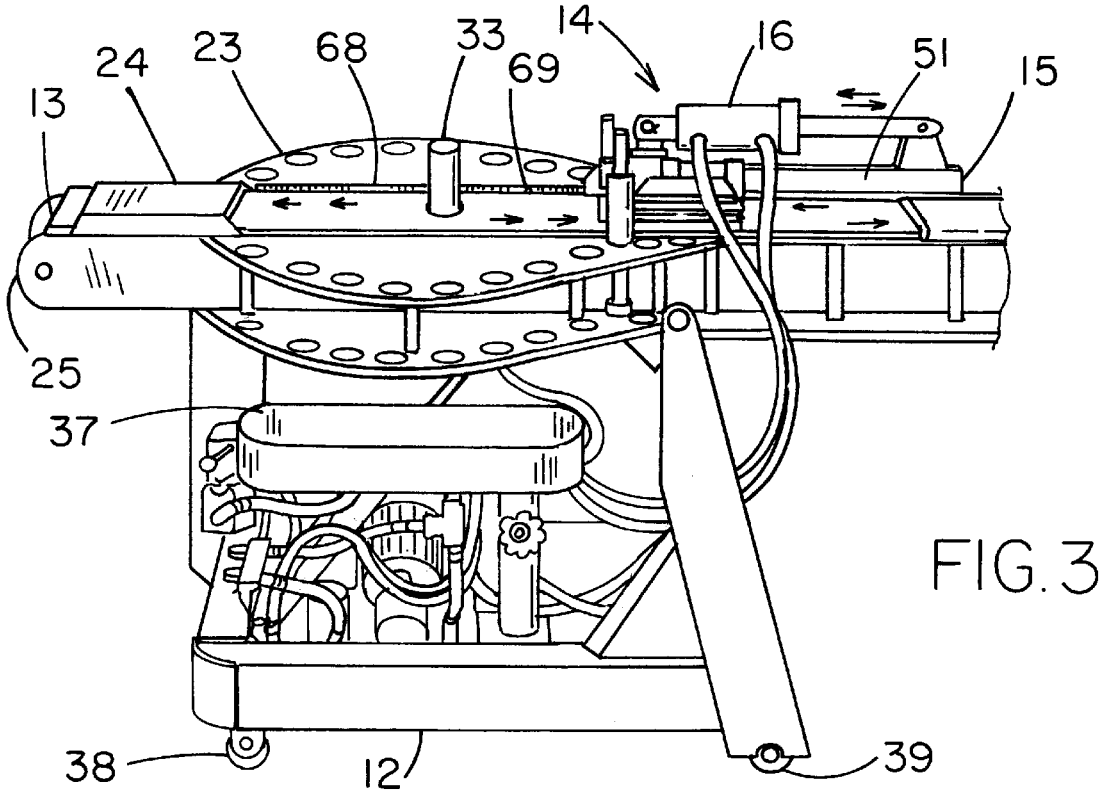
FIG. 3 is a schematic perspective view of the present invention.
Figure 4:
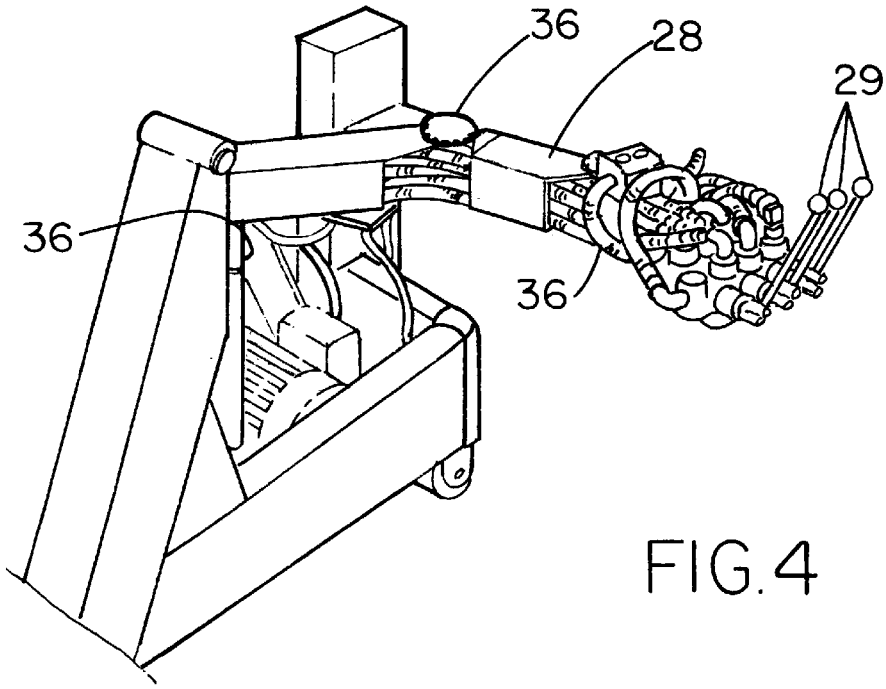
FIG. 4 is a schematic partial perspective view of the control arm of the present invention.

Preferably, the bed is pivotally mounted to the base and is pivotable between a vertical and a horizontal position. FIG. 1 shows the bed in the vertical position, while FIG. 3 shows the bed in the horizontal position. In an example of application, the bed may be positioned about midway between the horizontal and vertical positions to aim the ends of a tube being bent towards a corner formed between a wall and a ceiling as the object is bent. This permits long objects to be bent in relatively cramped quarters where the ends of the object would otherwise swing out and strike the wall during bending.

Figure 5:
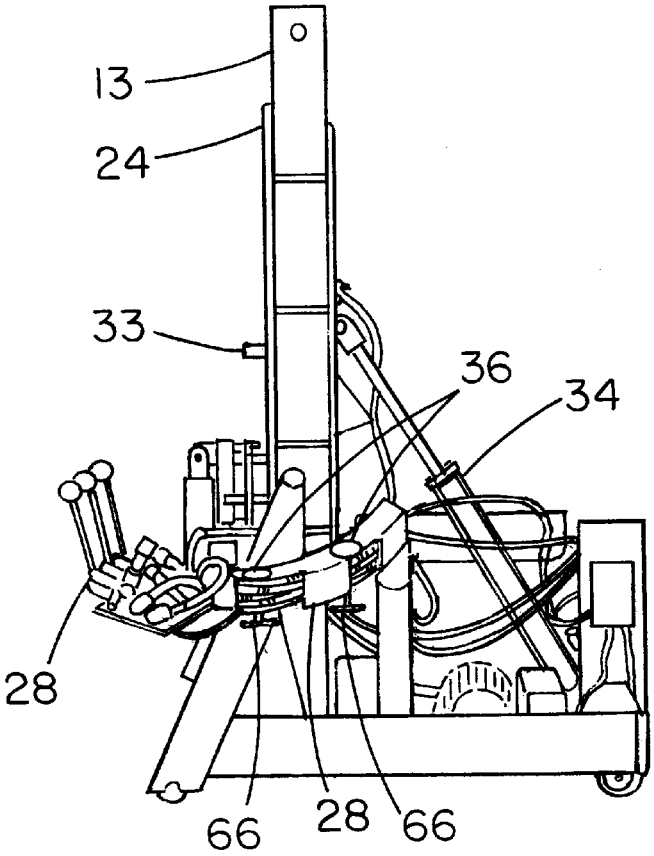
FIG. 5 is a schematic side view of the present invention.

Preferably, the control arm has at least one pivot point, and preferably three pivot points 36, to permit swinging of the control arm around to the front of the bed, as shown in FIG. 5, when the bed is in the vertical position so that a user is always in visual contact with the object being bent.

The base may also have a pair of casters 38 towards its front and a pair of rollers 39 towards its back.

The hydraulic system should include a pump 40 coupled to the base, a motor 41 for rotating the pump, and a plurality of hoses 42 extending between the control levers and the associated piston and cylinder actuators. Optionally, a fluid cooling unit (not shown) may be mounted or formed in one leg 43 of the base to cool the hydraulic fluid as it moves through the system.

In use, a die is selected based on the object to be bent and is mounted to the mounting arm. The limiting die may also be mounted to the bending apparatus. The stop pegs are placed in holes of the bed that are positioned towards the die. The mounting arm moves the die such that the stop pegs are positioned between the die and the rest of the bending apparatus. The object to be bent is positioned between the die and the stop pegs. The mounting arm retracts away from the object, pulling the die against the object, which is bent under the pressure. FIG. 9 illustrates an object being bent. For larger objects, the sliding panel is moved to bend the pipe, with the bending apparatus remaining stationary.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A machine for bending objects, comprising:

a base;

a bed mounted to said base, said bed including a sliding panel, said sliding panel being for moving relative to said bed;

a bending apparatus mounted to said sliding panel, said bending apparatus having a mounting arm slidably positionable with respect to said sliding panel;

a mounting die mountable to said mounting arm of said bending apparatus, said mounting die being adapted for engaging an object;

a pair of spaced stop pegs extending outwardly from said bed, said sliding panel being positioned to pass between said pair of stop pegs;

said bending apparatus having a bending apparatus frame;

a limiting die being mountable to said bending apparatus frame of said bending apparatus, said limiting die being adapted for abutting the object for limiting an extent of bending of the object as the bending apparatus is passed between said spaced pair of stop pegs; and said mounting arm being adjustably positionable such that said mounting die and said limiting die are adapted for positioning on opposite sides of the object for securing the object between said mounting die and said limiting die.

2. The machine of claim 1, wherein said sliding panel is substantially centrally positioned to extend between front and rear ends of said bed, said sliding panel being slidably positionable along said bed between said front and rear ends of said bed.

3. The machine of claim 1, wherein said bed is pivotally mounted to said base, said bed being pivotable between a vertical and a horizontal position.

4. The machine of claim 1, further comprising:

said bed being structured to include a plurality of spaced aperture pairs, each said aperture pair being aligned substantially transverse to a longitudinal axis of said bed, said spaced aperture pairs being positioned such that one aperture of each spaced aperture pair is positioned on an opposite side of said sliding panel from the other aperture of said spaced aperture pair, each aperture of each said spaced aperture pair being for receiving a respective one of said pair of stop pegs therein.

5. The machine of claim 1, further comprising:

a graduated indicator mounted to said bed proximate said sliding panel; and an indicator member coupled to said sliding panel proximate said graduated indicator for providing visual indication of a distance traveled by said sliding panel, whereby an amount of bending is monitorable.

6. A machine for bending objects, comprising:

a base;

a bed mounted to said base, said bed including a sliding panel, said sliding panel being for moving relative to said bed;

a bending apparatus mounted to said sliding panel, said bending apparatus having a mounting arm slidably positionable with respect to said sliding panel;

a bending die mountable to said mounting arm of said bending apparatus, said mounting die being adapted for engaging an object;

a pair of spaced stop pegs extending outwardly from said bed, said sliding panel being positioned to pass between said pair of stop pegs;

a control arm coupled to said base for controlling positioning of said bending apparatus; and said control arm having at least one pivot point along an extent of said control arm, said control arm further being pivotally coupled to said frame such that said control arm is adapted for adjusting a working position of said control arm relative to said bed of said machine.

7. The machine of claim 6, further comprising:

each pivot point along said control arm having an associated locking device for selectively preventing pivoting of said control arm about said pivot point whereby said control arm is selectively lockable into a static position.

8. The machine of claim 6, further comprising:

said bed being structured to include a plurality of spaced aperture pairs, each said aperture pair being aligned substantially transverse to a longitudinal axis of said bed, said spaced aperture pairs being positioned such that one aperture of each spaced aperture pair is positioned on an opposite side of said sliding panel from the other aperture of said spaced aperture pair, each aperture of each said spaced aperture pair being for receiving a respective one of said pair of stop pegs therein.

9. The machine of claim 6, further comprising:

a graduated indicator mounted to said bed proximate said sliding panel; and an indicator member coupled to said sliding panel proximate said graduated indicator for providing visual indication of a distance traveled by said sliding panel, whereby an amount of bending is monitorable.

10. The machine of claim 6, wherein said bed is pivotally mounted to said base, said bed being pivotable between a vertical and a horizontal position.

11. A machine for bending objects, comprising:

a base;

a bed mounted to said base, said bed including a sliding panel, said sliding panel being for moving relative to said bed, a bending apparatus mounted to said sliding panel, said bending apparatus having a mounting arm slidably positionable with respect to said sliding panel, a bending die mountable to said mounting arm of said bending apparatus, said mounting die being adapted for engaging an object;

a pair of spaced stop pegs extending outwardly from said bed, said sliding panel being positioned to pass between said pair of stop pegs; and wherein said base has a tray pivotally coupled to said base, said tray being adapted for holding a plurality of dies.

12. A machine for bending objects, comprising:

a base;

a bed mounted to said base, said bed including a sliding panel, said sliding panel being for moving relative to said bed, a bending apparatus mounted to said sliding panel, said bending apparatus having a mounting arm slidably positionable with respect to said sliding panel;

a bending die mountable to said mounting arm of said bending apparatus, said mounting die being adapted for engaging an object;

a pair of spaced stop pegs extending outwardly from said bed, said sliding panel being positioned to pass between said pair of stop pegs; and wherein said bending apparatus further includes a bending apparatus frame, said mounting arm, and a lift assembly for selectively positioning said bending apparatus frame in spaced relationship to said sliding panel such that said bending apparatus is adapted for selectively clamping the object between said bending apparatus frame and said sliding panel.

13. The machine of claim 12, further comprising:

said bed being structured to include a plurality of spaced aperture pairs, each said aperture pair being aligned substantially transverse to a longitudinal axis of said bed, said spaced aperture pairs being positioned such that one aperture of each spaced aperture pair is positioned on an opposite side of said sliding panel from the other aperture of said spaced aperture pair, each aperture of each said spaced aperture pair being for receiving a respective one of said pair of stop pegs therein.

14. The machine of claim 12, further comprising:

a graduated indicator mounted to said bed proximate said sliding panel; and an indicator member coupled to said sliding panel proximate said graduated indicator for providing visual indication of a distance traveled by said sliding panel, whereby an amount of bending is monitorable.

15. The machine of claim 12, wherein said bed is pivotally mounted to said base, said bed being pivotable between a vertical and a horizontal position.

16. A machine for bending objects, comprising:

a base;

a bed mounted to said base said bed including a sliding panel, said sliding panel being for moving relative to said bed;

a bending apparatus mounted to said sliding panel, said bending apparatus having a mounting arm slidably positionable with respect to said sliding panel;

a bending die mountable to said mounting arm of said bending apparatus, said mounting die being adapted for engaging an object;

a pair of spaced stop pegs extending outwardly from said bed, said sliding panel being positioned to pass between said pair of stop pegs; and said mounting arm being extendable from opposite sides of the bending apparatus frame.

17. The machine of claim 16, further comprising:

said bending die being selectively mountable to one of a first and a second end of said mounting arm.

18. The machine of claim 16, further comprising:

said bed being structured to include a plurality of spaced aperture pairs, each said aperture pair being aligned substantially transverse to a longitudinal axis of said bed, said spaced aperture pairs being positioned such that one aperture of each spaced aperture pair is positioned on an opposite side of said sliding panel from the other aperture of said spaced aperture pair, each aperture of each said spaced aperture pair being for receiving a respective one of said pair of stop pegs therein.

19. The machine of claim 16, further comprising:

a graduated indicator mounted to said bed proximate said sliding panel; and an indicator member coupled to said sliding panel proximate said graduated indicator for providing visual indication of a distance traveled by said sliding panel, whereby an amount of bending is monitorable.

20. The machine of claim 16, wherein said bed is pivotally mounted to said base, said bed being pivotable between a vertical and a horizontal position.

21. A machine for bending objects, comprising:

a base;

a bed mounted to said base, said bed including a sliding panel, said sliding panel being for moving relative to said bed;

a bending apparatus mounted to said sliding panel, said bending apparatus having a mounting arm slidably positionable with respect to said sliding panel;

a bending die mountable to said mounting arm of said bending apparatus, said mounting die being adapted for engaging an object;

a pair of spaced stop pegs extending outwardly from said bed, said sliding panel being positioned to pass between said pair of stop pegs;

a mounting member extending from said sliding panel proximate an end of said bending apparatus;

said mounting member being for coupling a limiting die thereto; and said bending die being mountable to said mounting arm such that said mounting arm is extendable towards said mounting member whereby said mounting die and said limiting die are adapted for positioning on opposite sides of the object for securing the object between said mounting die and said limiting die.

22. A machine for bending objects, comprising:

a base;

a bed mounted to said base;

a bending apparatus mounted to said bed and having a mounting arm being slidably positionable with respect to said bed;

said bending apparatus having a first hydraulic piston and cylinder actuator for moving said mounting arm along said bending apparatus;

a bending die mounted to said mounting arm of said bending apparatus and adapted for engaging an object;

a pair of stop pegs extending outwardly from said bed;

said bed having a centrally positioned sliding panel extending between front and rear ends thereof, said sliding panel being slidably positionable along said bed between its front and rear ends, said bending apparatus being coupled to said sliding panel;

a second hydraulic piston and cylinder actuator moving said sliding panel along a remainder of said bed;

a control arm coupled to said base and having a plurality of hydraulic controls in fluid communication with a hydraulic system for controlling flow of hydraulic fluid to said first and second hydraulic piston and cylinder actuators;

a limiting die being mountable to said bending apparatus for limiting an extent of bending of said object;

said sliding panel of said bed having a mounting member extending therefrom, said mounting member being adapted for receiving second dies;

said bed being pivotally mounted to said base and being pivotable between a vertical and a horizontal position;

a third hydraulic piston and cylinder actuator positioning said bed between said vertical and horizontal positions;

said control arm having at least one pivot point; and said base having a tray pivotally coupled thereto and adapted for holding a plurality of dies.

23. A machine for bending objects, comprising:

a base;

a bed mounted to said base, said bed including a sliding panel, said sliding panel being for hydraulically moving relative to said bed;

a bending apparatus mounted to said sliding panel, said bending apparatus having a bending apparatus frame, a mounting arm, and a lift assembly for selectively hydraulically positioning said bending apparatus frame in spaced relationship to said sliding panel such that said bending apparatus is adapted for selectively clamping an object between said bending apparatus frame and said sliding panel;

said mounting arm being hydraulically positionable with respect to said sliding panel;

a mounting die being selectively mountable to one of a first and a second end of said mounting arm, said mounting arm being extendable from opposite sides of said bending apparatus frame;

said mounting die being adapted for engaging the object;

a pair of spaced stop pegs extending outwardly from said bed, said sliding panel being positioned to pass between said pair of stop pegs;

wherein said sliding panel is substantially centrally positioned to extend between front and rear ends of said bed, said sliding panel being slidably positionable along said bed between said front and rear ends of said bed;

a control arm coupled to said base for controlling positioning of said bending apparatus;

wherein a limiting die is mountable to said bending apparatus frame of said bending apparatus, said limiting die being adapted for abutting the object for limiting an extent of bending of the object as the bending apparatus is passed between said spaced pair of stop pegs;

said mounting arm being adjustably positionable such that said mounting die and said limiting die are adapted for positioning on opposite sides of the object for securing the object between said mounting die and said limiting die;

wherein said bed is pivotally mounted to said base, said bed being pivotable between a vertical and a horizontal position;

said control arm having at least one pivot point along an extent of said control arm, said control arm further being pivotally coupled to said frame such that said control arm is adapted for adjusting a working position of said control arm relative to said bed of said machine;

each pivot point along said control arm having an associated locking device for selectively preventing pivoting of said control arm about said pivot point whereby said control arm is selectively lockable into a static position;

wherein said base has a tray pivotally coupled to said base, said tray being adapted for holding a plurality of dies;

said bed being structured to include a plurality of spaced aperture pairs, each said aperture pair being aligned substantially transverse to a longitudinal axis of said bed, said spaced aperture pairs being positioned such that one aperture of each spaced aperture pair is positioned on an opposite side of said sliding panel from the other aperture of said spaced aperture pair, each aperture of each said spaced aperture pair being for receiving a respective one of said pair of stop pegs therein;

a graduated indicator mounted to said bed proximate said sliding panel; and a pointer member coupled to said sliding panel proximate said graduated indicator for providing visual indication of a distance traveled by said sliding panel, whereby an amount of bending is monitorable;

a mounting member extending from said sliding panel proximate an end of said bending apparatus;

said mounting member being for selectively coupling a mounting die thereto;

said bending die being mountable to said mounting arm such that said mounting arm is extendable towards said mounting member whereby said mounting die and said mounting die are adapted for positioning on opposite sides of the object for securing the object between said mounting die and said mounting die;

a first hydraulic piston and cylinder actuator being for extending and retracting said mounting arm relative to said bending apparatus frame;

a second hydraulic piston and cylinder actuator being for moving said sliding panel relative to said bed;

a third hydraulic piston and cylinder actuator being for positioning said bed between said vertical and horizontal positions; and a fourth hydraulic piston and cylinder actuator being for moving said bending apparatus frame relative to said sliding panel.

* * * * *